United States Patent [19]

Schuck

[11] 4,156,584

[45] May 29, 1979

[54] LIQUID CRYOGEN PUMP

[75] Inventor: Thomas W. Schuck, Easton, Pa.

[73] Assignee: Carpenter Technology Corporation, Reading, Pa.

[21] Appl. No.: 706,455

[22] Filed: Jul. 19, 1976

[51] Int. Cl.[2] ..... F04B 15/08; F15B 21/04

[52] U.S. Cl. ..... 417/435; 92/83; 92/162 R; 417/570; 417/901

[58] Field of Search ..... 417/435, 901, 569, 570; 62/55; 92/83, 86.5, 162

[56] References Cited

U.S. PATENT DOCUMENTS

| | | | |
|---|---|---|---|
| 298,874 | 5/1884 | Merrell | 417/569 |
| 1,895,295 | 1/1933 | Picard | 417/901 X |
| 2,054,710 | 9/1936 | Okada | 417/901 X |
| 2,730,957 | 1/1956 | Riede | 417/569 |
| 2,888,879 | 6/1959 | Gaarder | 417/901 X |
| 2,931,313 | 4/1960 | Hughes | 417/901 X |
| 3,136,136 | 6/1964 | Gottzmann | 417/901 X |
| 3,431,744 | 3/1969 | Veilex et al. | 62/55 |

*Primary Examiner*—Carlton R. Croyle
*Assistant Examiner*—Leonard E. Smith
*Attorney, Agent, or Firm*—Edgar N. Jay

[57] ABSTRACT

A liquid cryogen pump in which liquid is maintained on both sides of the pump piston during operation. In the preferred embodiment, vapor, when present in the pump chamber, is passed from in front to behind the piston by providing a predetermined clearance between the piston and the cylinder in which it is reciprocated. The clearance is preferably large enough to pass enough liquid cryogen to maintain the desired head of liquid behind the piston. In the embodiment set forth, the pump is arranged so that it can be immersed in the liquid cryogen to be pumped with its pumping chamber and valves at or close to the bottom of the liquid cryogen supply. Heat transfer between the warm, upper end of the pump and its cold end is effectively restricted, and, preferably, the warm end is connected to the cold end of the pump by thin-walled tubular members formed of low thermal conductive materials to minimize heat transfer by conduction.

15 Claims, 7 Drawing Figures

LIQUID CRYOGEN PUMP

BACKGROUND OF THE INVENTION

This invention relates to liquid cryogen pumps and, more particularly, to an improved pump for compressing, subcooling and transferring liquid helium.

Cryogenic liquids which are easily vaporized at atmospheric temperatures are difficult to handle because of the need to maintain them below their boiling points. Liquid helium is particularly difficult to handle because of its extremely low boiling point of about 4.2° K. at one atmosphere, with a critical temperature of only 5.2° K. In addition, it requires far less heat to vaporize helium than other liquid cryogens.

When pumping a liquid cryogen, a certain amount of heat will inevitably be introduced to the liquid from pump friction and transfer from the atmosphere. For this reason, cryogens are sometimes subcooled prior to pumping by heat transfer from colder fluids. Because liquid helium has such a low boiling point, it cannot be economically subcooled very much prior to pumping so that heat added to the liquid helium during pumping will readily cause vaporization resulting in low pump efficiency.

Conventional reciprocating piston-cylinder type pumps are not well suited for pumping liquid helium because the heat generated by friction causes vaporization of the helium. This is because such pumps are generally designed to minimize leakage around the piston, with the result that heat is generated by the friction between the piston and the cylinder. U.S. Pat. No. 2,054,710 issued to J. Okada on Sept. 15, 1936 relates to such a pump constructed so that a substantial amount of the fluid in the variable volume pumping chamber is returned to the supply through holes provided for that purpose in the cylinder wall which are located so as to extend from about 80% of the suction stroke to the end thereof. Such an arrangement results in an unduly high loss of efficiency. U.S. Pat. No. 3,431,744 issued to R. Veilex et al on Mar. 11, 1969 relates to a reciprocating piston-cylinder type pump not suited for pumping a liquid such as helium which is not desired to be vaporized. In the Veilex pump, the pump discharge is through the piston to the space above and no provision is made for removing vapor from the pump discharge. Other types of pumps, such as centrifugal pumps, have been used with some success, but generally only for relatively low pressure differentials below about 7 psi (48 kPa) and high flow rates above about 10 gal/min ($6.3\times10^4$ $m^3$/sec).

SUMMARY OF THE INVENTION

It is, therefore, a principal object of this invention to provide an improved pump for liquid helium.

It is a further object to provide such a pump which uses a minimum of energy and which tranfers a minimum of heat to either input or discharge helium.

Another object is to provide such a pump in which vaporization of helium is minimized.

Yet another object is to provide such a pump in which the amount of helium vapor in the pumps discharge is minimized.

A still further object is to provide such a pump which can discharge liquid helium at a temperature and pressure such that the helium discharge is at a temperature well below its saturation temperature.

In accordance with a preferred embodiment of this invention, a reciprocating piston-cylinder pump is provided for subcooling liquid helium by compressing it substantially isentropically. Vapor which may accumulate in the pumping chamber is passed through a clearance provided between the piston and the cylinder during the start of the compression stroke. This aids in providing increased pump efficiency by leaving substantially only liquid to be discharged from the pumping chamber. A supply of liquid is maintained above the piston to insure that vapor does not flow back into the pumping chamber. The pressure of this liquid supply is controlled so that it is substantially less than the pump discharge pressure and, preferably, is close to the pressure of the liquid in the dewar. Thus, the pump is constructed with a relatively large clearance between the piston and cylinder as compared to ordinary reciprocating pumps and this has the further advantage of minimizing the amount of heat generated by friction. In addition, the materials used for the piston, piston rings, and cylinder are selected according to their expansion coefficients so that clearance will be maintained when the juxtaposed parts are at liquid helium temperatures.

DESCRIPTION OF THE DRAWINGS

Further objects as well as advantages of the present invention will be apparent from the following description of a preferred embodiment thereof and the accompanying drawings in which.

DESCRIPTION OF THE PREFERRED EMBODIMENT

The present invention will now be described in connection with a liquid helium pumping system. While the present invention is especially well suited for and is advantageously used for this purpose, it is not intended thereby to limit this invention, which can also be advantageously used to pump other cryogenic liquids such as liquid nitrogen or oxygen.

Figure 1:
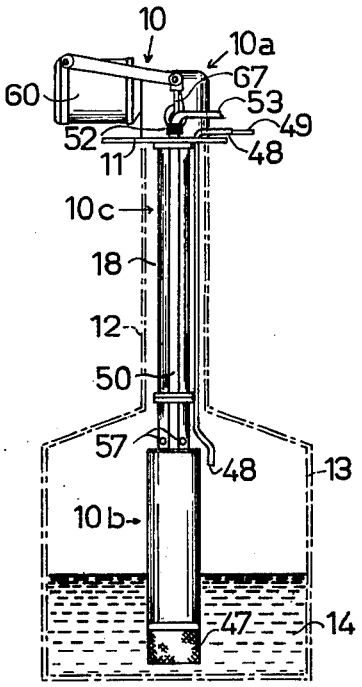
FIG. 1 is an elevational view, partially diagrammatic of a pump constructed in accordance with this invention shown in position in a dewar containing liquid helium.

Referring to the drawings in detail and, in particular, to FIG. 1, the cryogenic liquid pumping system of this invention comprises a pump 10 secured to base plate 11 shown positioned on the end of neck 12 of a vacuum-insulated helium container or dewar 13. Pump 10 is made up of an upper section which comprises motive means **10*a* mounted on top of base plate 11, a lower section which comprises pumping means 10*b* shown partially immersed in liquid helium 14, and a connecting section 10c which connects the motive means 10a to the pumping means 10b. The connecting section 10c depends from base plate 11 and extends down through neck 12** to support the lower section.

Figure 2:
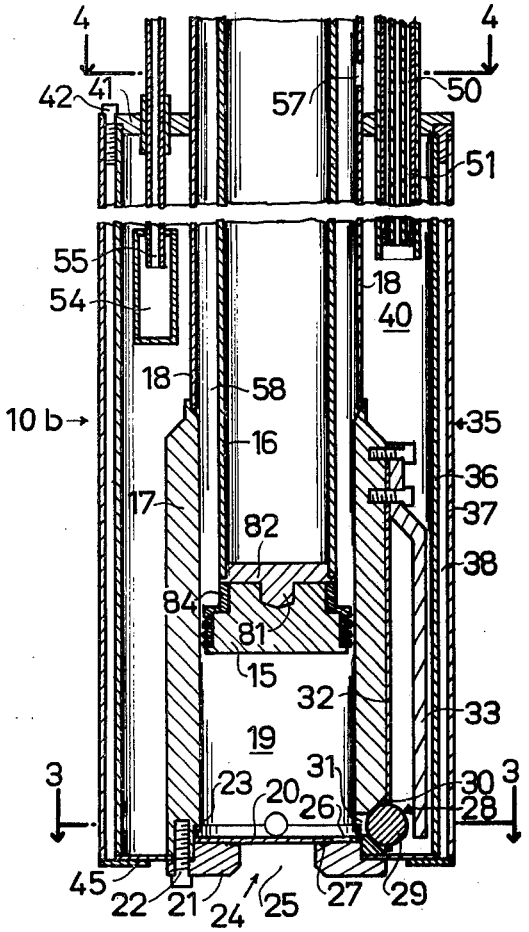
FIG. 2 is a vertical sectional view through the line 2—2 of FIG. 3 of the lower portion of the pump partially cut away for convenience.
Figure 3:
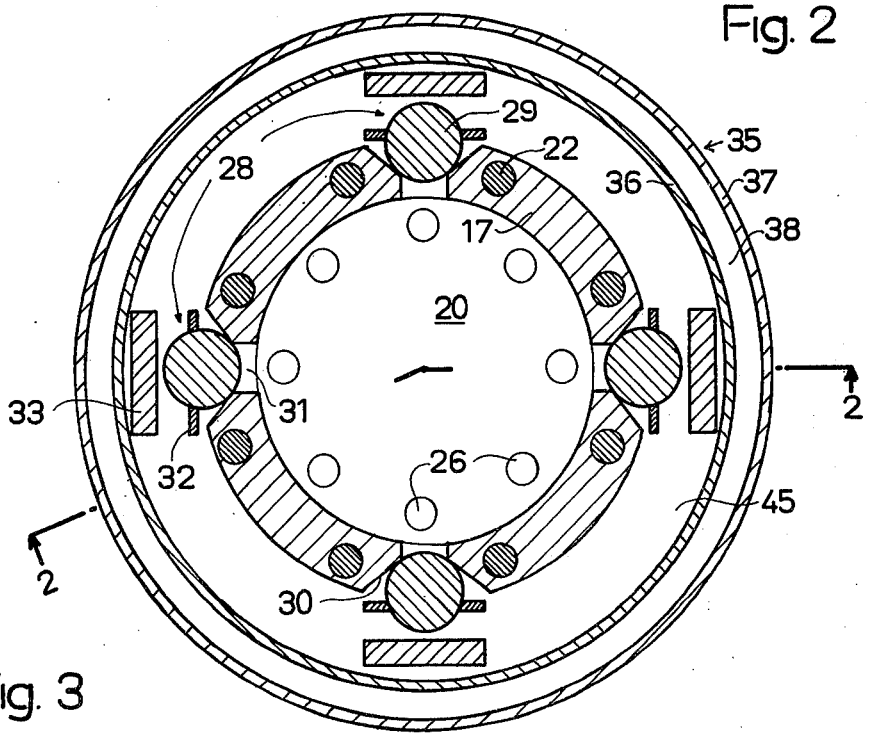
FIG. 3 is a cross-sectional view on an enlarged scale through the line 3—3 of FIG. 2.

Referring now to FIGS. 1, 2 and 3, pumping means 10b comprises a piston rod 16 connected at one end to piston 15 which is positioned to reciprocate vertically in pump cylinder 17. The upper end of the cyliner 17 is attached to support tube 18 which, in turn, depends from base plate 11. An annular space 58 defined between piston rod 16 and cylinder 17 together with support tube 18 extends from the top of piston 15 up to the underside of base plate 11. Piston rod 16, and support tube 18 are preferably formed from A.I.S.I. type 300 series austenitic stainless steels because of their low thermal conductivity at cryogenic temperatures as well as their desirable structural properties, with piston rods and support tubes constructed of A.I.S.I. type 304 stainless steel, giving good results. Piston rod 16 is preferably a thin-walled tubular member, because such a structure minimizes heat-conducting area while maximizing column inertia and resistance to compressive buckling. Thus, both the support tube 18 and piston rod 16 are constructed to minimize heat transfer from the motive means 10a and base plate 11 which are exposed to room temperature, to the pumping section 10b which operates at cryogenic temperatures. Cylinder 17 is preferably made of an A.I.S.I. type 300 series steel, and preferably has a relatively large wall thickness to minimize heat transfer to the liquid helium which it contains, as will be discussed hereinbelow. Cylinder 17 having a wall thickness of about a half inch (1.27 cm) and formed of A.I.S.I. types 304 or 321 stainless steel gave good results. Piston 15 is preferably made of a controlled expansion alloy such as Invar, a 36% nickel iron-nickel alloy, for reasons which will be discussed hereinbelow.

At the bottom of a pumping chamber 19, formed by the lower part of cylinder 17 under piston 15, there is an inlet valve assembly 24 made up of a plate 20 in the form of a round disk which fits loosely into the lower end of cylinder 17 and rests on annular inlet valve seat 21 connected, as by bolts 22, to the bottom end of cylinder 17.

The end of cylinder 17, in which the plate 20 fits, is counterbored to form a circular lip 23 which limits the vertical movement of plate 20 within the thus enlarged end portion of the cylinder 17. Inlet opening 25, formed by the inside of annular seat 21, is open at its lower end to the supply of liquid helium 14 contained in dewar 13. A plurality of inlet holes 26 are formed through plate 20 near its periphery, whereby when plate 20 is raised to open valve 24, liquid helium 14 can flow through inlet opening 25, through the space between plate 20 and seat 21, and then through inlet holes 26 into pumping chamber 19. When valve 24 is closed, the inlet holes 26 are blocked by seat 21 on which are formed circumferentially extending grooves 27 for better sealing engagement between plate 20 and seat 21.

Outlet valves 28 are provided near the bottom of cylinder 17, four outlet valves 28 as shown in FIG. 3 being preferred, although as few as one or more than four could be used. The number of outlet valves 28 employed depends primarily on hydraulic considerations, the objective being to reduce the pressure drop across the total number of valves while maintaining a sufficiently responsive valve assembly so that closure of the valves is assured rapidly after completion of the discharge stroke.

Each of the outlet valves 28 comprises a ball 29 which seats on a conical outlet valve seat 30, thus blocking an associated outlet hole 31 which is formed through cylinder 17. The ball 29 is urged into valve seat 30 by leaf spring 32 having a hole formed through it with a diameter less than that of ball 29 to receive and hold ball 29 in position on the valve seat 30. Leaf spring 32 together with a valve stop 33, as shown are connected to and extend downwardly along cylinder 17. The lower portion of valve stop 33 stands off from cylinder 17 and is positioned to limit lateral movement of the ball 29.

The valve outlet holes 31 open into a discharge chamber 40 formed around the exterior of cylinder 17 and the lower portion of support tube 18 by discharge chamber wall 35 sealed adjacent to its bottom end to the valve seat 21. The upper end of the discharge chamber 40 is closed by a top plate 41 connected as by bolts 42 to the wall 35 and to support tube 18 as by welding. As shown, discharge chamber wall 35 is a vacuum-insulated double wall assembly comprising an inner wall 36 and an outer wall 37 with a vacuum space 38 between them. The bottom of discharge chamber 40 is closed by a bottom plate 45 welded to the wall assembly 35 and sealed to cylinder 17 and the inlet valve seat 21 by bolts 22. Preferably, an inlet screen 47 is fitted over the bottom of the pump as shown in FIG. 1 to protect the pump from coarse particles, the screen 47 also serving to maintain the bottom of the inlet opening 25 far enough from the bottom of the dewar 13 to allow free flow of the liquid.

Extending into the discharge chamber 40 is a metal discharge sheath 50 through which a vacuum-insulated discharge bayonet 51 extends. The sheath 50, with the bayonet 51, extends from the discharge chamber up through the top plate 41 and the base plate 11 terminating with a connector 52 above the base plate 11, to which is connected a conduit 53 going to the downstream equipment. If desired, the discharge bayonet 51 may be connected directly to the downstream equipment, eliminating the need for the connector 52 and conduit 53. If continuous operation is desired, a metal supply sheath 48 extending through base plate 11 containing vacuum-insulated supply bayonet 49 may be provided to add helium to the liquid supply 14 as helium is pumped out discharge bayonet 51.

Means for measuring the temperature and pressure of the fluid in the discharge chamber may also be provided. To measure temperature, vapor bulb 54 containing helium, is connected by means of a pressure tube 55 to a pressure gauge (not shown). Changes in temperature will change the vapor pressure of the liquid helium in the bulb 54, and the temperature can then be deduced from the pressure measured by the pressure gauge. Another pressure gauge (not shown) may be connected by pressure tube 56 to a pressure tap (not shown) through top plate 41 to allow reading of the pressure in the discharge chamber 40.

Figure 4:
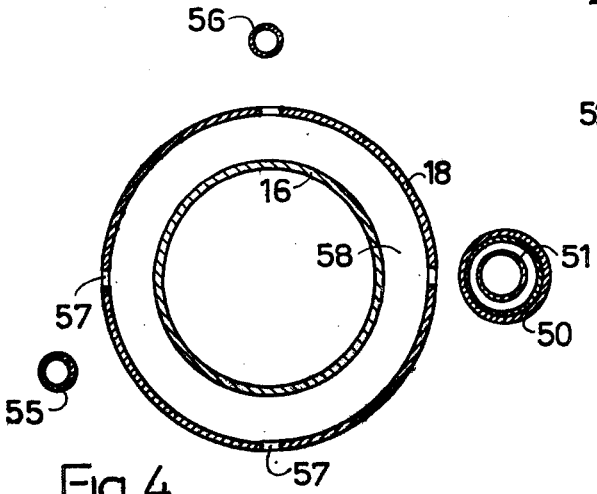
FIG. 4 is a cross-sectional view on the line 4—4 of FIG. 2.

One or more overflow ports 57 formed through support tube 18, are provided as shown in FIGS. 2 and 4. As will be more fully pointed out herein below, during operation of the pump, liquid helium which collects in annular space 58 above piston 15 flows through the ports 57 back into the dewar 13. To minimize the pressure drop of the helium flowing back into the dewar 13, preferably a plurality of ports 57 are provided, preferably spaced circumferentially, with four evenly spaced ports 57 as shown in FIG. 4 giving good results.

Figure 5:
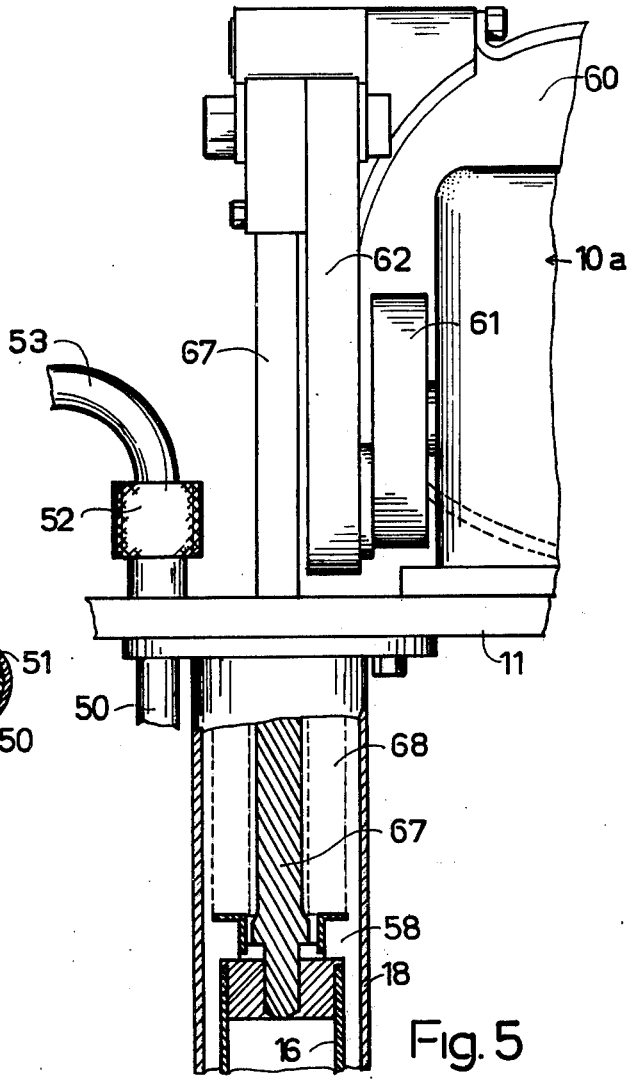
FIG. 5 is an elevational view, partially in section, of the upper portion of the pump.

Referring now to FIG. 5 where the upper or motive section 10*a* of the pump is shown with the parts at the bottom of the pumping stroke, motor 60 drives connecting od 67 through a crank 61 and link 62 mounted, as shown, to impart vertical reciprocating motion to the connecting rod 67. The connecting rod 67 extends through base plate 11 and a gas-tight bellows 68 for attachment to the upper end of piston rod 16. The bellows 68 is connected between the base plate 11 and piston rod 16 to prevent leakage between annular space 58 and the atmosphere while permitting the piston 15 to reciprocate.

Figure 7:
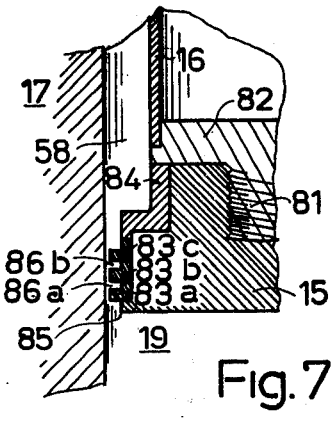
FIG. 7 is a fragmentary sectional view on an enlarged scale of the piston assembly.

As shown in FIGS. 2 and 7, piston 15 is demountably secured onto threaded member 81 which is part of a plug 82 which is fitted into and seals the end of piston rod 16. A plurality of endless piston rings are mounted about the periphery of piston 15, three rings 83*a*, 83*b* and 83*c* are shown, the former being the bottommost ring and the latter being the topmost ring. The rings 83*a–c* are held in place by clamp 84 which serves to compress the rings tightly against lip 85, clamp 84 being held in place by plug 82. A clearance is provided between the outer diameters of the piston rings 83*a–c* and the inner diameter of cylinder 17 to minimize friction between them during operation, thus minimizing heat generation, wear, and wear particles and to allow controlled leakage from the pumping chamber 19 past the piston into space 58.

The rings 83*a–c* are preferably formed from a material which can rub against cylinder 17 with a minimum of friction and a maximum of wear resistance. The ring material should also be substantially fluid impermeable and have the necessary strength to withstand operational stresses. In like manner, the cylinder 17 is preferably formed of a material which can rub against the rings with a minimum of friction and which has high wear resistance. In addition, the cylinder material should have low thermal conductivity to minimize heat input to pumping chamber 19. The piston 15 is preferably formed of an alloy with a desired coefficient of expansion so as to obtain a desired clearance between the rings 83*a–c* and cylinder 17 at operating temperatures. In addition, because the cylinder 17 in generally cooled down before the piston 15 during start-up of the pump, as will be discussed hereinafter, it is necessary to select materials for the piston 15, rings 83*a–c*, and cylinder 17 that will not cause the clearance to be reduced excessively during the cool-down period, which would cause excessive friction and possible seizing.

Rings formed from nylon or polytetrafluoroethylene materials give good results when used with cylinders formed of austenitic A.I.S.I. type 300 stainless steels. A preferred piston for use with rings and cylinders of such materials is one formed of Invar (36% nickel, iron-nickel alloy) controlled expansion alloy. One suitable combination is A.I.S.I. type 304 stainless steel cylinder, Teflon/graphite type FOF-30 piston rings, and an Invar piston. With this combination of materials, a relatively large but operative clearance at 300° K. assembly temperature of 0.001 in/in diametral can be reduced to a desired operating clearance of 0.00025 in/in diametral at 4° K. operating temperature. Because the clearance remained within operational limits, the pump could be started at room temperature and pump fluid while cooling without binding.

As most clearly shown in FIG. 7, the rings 83*a–c* are L-shaped in profile and when stacked provide successive annular expansion spaces 86*a* and 86*b* between the areas where the rings are separated from the cylinder by a desired clearance. Thus, fluid from pumping chamber 19 is successively compressed and expanded as it is first forced through the restricted clearance between ring 83*a* and cylinder 17 and then into expansion space 86*a*. This is repeated as the fluid is forced past each of the rings until, as in the embodiment shown, the fluid is forced past ring 83*c* and expanded into space 58 above piston 15 in support tube 18, extending up to the underside of the base plate 11. This multiple expansion and compression of the fluid in going past the rings, serves to reduce the fluid energy and to allow controlled leakage of fluid out of pumping chamber 19.

To begin operation, pump 10 is assembled and mounted on base plate 11, and the supply sheath 48 and bayonet 49 and discharge sheath 50 and bayonet 51 are sealed into position. This entire assembly is then inserted into an empty dewar 13 so that base plate 11 rests on top of dewar neck 12, after which the system is sealed. The pump is then started and helium is fed into the dewar, first to flush out other gases and then to cool the system to operating temperatures. Until the interior of dewar 13 and the therein enclosed portion of pump 10 are cooled to below the boiling point of the helium (about 4°–5° K. depending on pressure), most of the helium added as liquid vaporizes very quickly so that only vapor is being pumped. When the components are cooled down enough, a supply of liquid helium 14 will collect in dewar 13 and pump 10 will begin to discharge some liquid. Steady operation is reached when pump 10 is discharging a substantially constant stream of liquid helium.

The operation of the pump will now be described in connection with a typical steady pumping cycle, starting with the piston 15 at its lowest position with both the outlet valves 28 closed and the inlet 24 closed. As the piston 15 moves upward, inlet valve 24 opens because of the differential pressure across plate 20 allowing liquid helium to flow from dewar 13 into pumping chamber 19, while at the same time, outlet valves 28 are held closed by leaf springs 32 and the difference in pressure created by therising piston. As the pumping chamber 19 fills with liquid helium, some of the liquid may vaporize with the vapor bubbles rising to the top of pumping chamber 19. When the piston 15 reaches the top of its input stroke, inlet valve 24 is free to close under the influence of gravity, while the outlet valve 28 remains closed also. A small vapor zone may have formed at the top of pumping chamber 19, just under piston 15, with an area below that of liquid containing some rising vapor bubbles.

During the downward or discharge stroke, outlet valves 28 are forced open, with inlet valve 24 being held closed. The liquid in the lower part of pumping chamber 19 is thus forced out through outlet valves 28 into discharge chamber 40. Simultaneously, vapor and vapor-liquid mixture in the upper part of pumping chamber 19 are forced through the clearance between piston rings 83*a–c* and cylinder 17. Because of the relatively low density of vapor compared to liquid, volumetrically the vapor flows through the clearance much faster than the liquid. Thus, the helium vapor is rapidly forced out of the pumping chamber 19, followed by a much smaller amount of liquid through the clearance, until the piston again reaches its lowest position and the inlet and outlet valves are closed. To minimize the temperature of the pumped liquid, substantially all of the vapor should be forced from the pumping chamber past the piston during each downward stroke.

By thus removing the vapor from the pumping chamber 19, the mass flow rate of liquid into the discharge chamber 40 is maximized because little or no vapor is pumped through outlet valves 28 and because the amount of vapor remaining in the pumping chamber 19 is minimized after the discharge stroke so that, at the initiation of the input stroke, expansion of residual vapor is insignificant by comparison with expansion of residual liquid which occurs nearly isentropically. Furthermore, as will be discussed hereinbelow, a liquid head is preferably maintained in space 58 above piston 15 to prevent drawing vapor into pumping chamber 19 from space 58 during the input stroke. In like manner, during the compression or discharge stroke, only a small portion of the energy is used to recompress vapor which reduces the energy input to the liquid during compression. However, it should be noted that liquid helium does have a relatively high compressibility compared to water, for example, and thus the expansion and compression of liquid helium in this pump will be more pronounced than for less compressible liquids.

Figure 6:
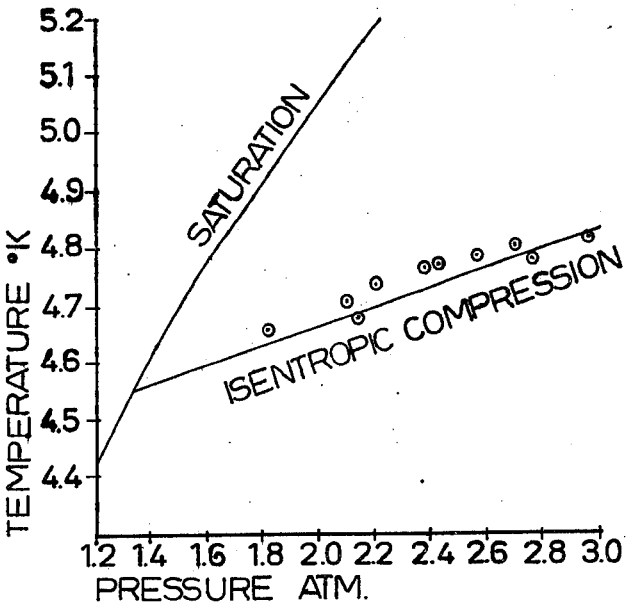
FIG. 6 is a graph on which discharge temperatures of liquid helium at various pressures during operation of a pump constructed in accordance with this invention have been plotted, with isentropic compression and saturation curves provided for comparison.

Because of the geometry of the piston rings 83*a–c*, the flow rate past the piston can be controlled by varying either the clearance or the number of rings. The desired leakage flow rate is determined by taking into account how much vapor is generated in the pumping chamber, and how much vapor can be tolerated in the discharge fluid. The amount of vapor generated is dependent, among other factors, upon the degree to which the supply liquid helium is pressurized above saturation pressure at its input temperature. FIG. 6 shows the saturation pressure for liquid helium at temperatures below its critical temperature of 5.2° K. Net positive suction head (NPSH) is a measure of the amount by which the liquid entering the pumping chamber is pressurized above its saturation pressure by the weight of the supply liquid in the dewar which is expressed as the height of the top of the input fluid above input port. The higher the NPSH, the higher the pressure is above saturation pressure.

When the NPSH is low, more gas will be generated in the pumping chamber 19 than when the NPSH is high, because at low NPSH the liquid is closer to its saturation temperature, and, therefore, a higher leakage flow rate will be needed in order to minimize the amount of vapor pumped into discharge chamber 40. When the supply helium has a high NPSH, smaller clearance should be used because very little vapor will form in the pumping chamber. However, some clearance should always be allowed in order to keep friction low.

During operation of the pump 10, helium passed by the piston 15 collects in space 58 and is vented through overflow ports 57 back into the dewar 13. Once steady operation is reached, liquid helium will generally fill the space 58 to the level of ports 57, with helium vapor filling the space 58 above the ports 57. During each upward stroke of piston 15, the liquid behind, that is above, the piston 15 will be raised and flow out through ports 57. This insures a minimum disturbance of the vapor filling the space 58 above ports 57 thereby, in turn, minimizing heat transfer by convection from the underside of base plate 11, the upper surface of which is exposed to room temperature. In some cases, having a small piston-cylinder clearance or because a high amount of vapor is present in the pumping chamber, liquid helium may not pass through the clearance to keep a liquid head on top of piston 15. In such instances, to prevent helium vapor being sucked into pumping chamber 19 from space 58 during the input stroke, thus reducing the pump efficiency, the head of liquid helium above piston 15 should be maintained by other means. For example, the level of the supply helium 14 can be kept above the height of the overflow ports 57 so that liquid supply helium 14 can flow into space 58 to maintain a head above piston 15. Because the moving components of the pumping means 10*b* and connecting means 10*c* are all enclosed within the discharge chamber wall 35 and the support tube 18, the liquid and vapor in the dewar 13 outside the pump are subjected to a minimum of disturbance by the pumping action, thus keeping the vapor space in the dewar 13 quiescent and thus minimizing convection heat transfer from the base plate down through the dewar neck 12.

To illustrate the thermodynamics of this system, a pump built in accordance with this invention was used to pump liquid helium at an input pressure of 1.36 atm and temperature of 4.57° K. FIG. 6 shows a curve labeled SATURATION giving the saturation temperatures of liquid helium at pressures from 1.2 atm to the critical pressure of 2.245 atm at the critical temperature of 5.2° K., and a curve labeled ISENTROPIC COMPRESSION giving the temperatures and pressures of helium with the same entropy as the input liquid helium at pressures up to 3.0 atmospheres. The data for these curves is from R. D. McCarty, *Thermophysical Properties of Helium-4 from* 2 *to* 1500 *K with Pressures to* 1000 *Atmospheres,* TN 631, Cryogenics Division, National Bureau of Standards (1972). The circled data points near the isentropic compression curve are the discharge temperatures and pressures, measured in the discharge chamber, of liquid helium discharged from the pump 10 at different pressures up to 3.0 atmospheres. As can be seen, those points nearly coincide with the isentropic compression curve, indicating that the operation produced nearly isentropic compression indicating high thermodynamic efficiency.

It can also be seen that the temperature of the discharged liquid at the various discharge pressures was higher than that of the input liquid. However, those discharge temperatures are well below the saturation temperatures at the corresponding discharge pressures, indicating that the discharge liquid was at a temperature below its saturation point. In this manner, the pump, therefore, sub-cools the liquid helium, even though the actual temperature of the helium is raised. Sub-cooled liquid helium can absorb heat without vaporizing, since the heat will simply raise the liquid temperature until the saturation temperature is reached. This sub-cooled liquid is particularly useful when the liquid must be transported over a distance without vaporizing.

It is because the discharge helium is at a higher temperature than the input helium that the cylinder 17 is made of thermally insulative material, since heat from the discharge chamber 40 could cause vaporization of the liquid in pumping chamber 19. For similar reasons, discharge chamber wall 35 is vacuum-insulated to minimize heat transfer to the supply helium 14 in dewar 13, which would result in some supply liquid being vaporized. However, if it is desired to achieve maximum sub-cooling of the discharge helium, and if vaporization of the supply helium is less important, then discharge chamber wall 35 could be made thermally conductive in which case the discharge liquid would exchange heat with and be further cooled by the supply liquid 14.

The piston 15, piston rings 83*a–c*, and cylinder 17 hereinabove described is the preferred configuration for achieving the controlled leakage and low friction operation of this pump. However, other configurations could also be used. For example, the rings could be mounted in grooves formed in the inside surface of the cylinder, in which case the piston would have a smooth outer surface; and the expansion spaces would be between the piston and the rings. In another configuration, the rings could be eliminated entirely, and the clearance and expansion spaces provided by closely fitting the piston in the cylinder and providing circumferential grooves in either the piston outer diameter or the cylinder inner surface.

As shown, outlet valves 28 minimize wear of the valve balls 29, but are not self-centering, and proper operation requires that each of the balls 29 be retained in alignment with its valve seat. The balls 29 can readily be self-centering by forming the opening in each spring 32 larger than the associated ball and extending each of the lower portions of the springs 32 back along the outside of the associated ball so as to trap the ball adjacent to the valve port 31. Such an arrangement may result in undesired wear of the valve balls 29. Yet another outlet valve construction is contemplated, which may minimize wear, utilizing springbiased flat valve discs instead of balls and flat seating surfaces formed on the outer surface of the wall of the cylinder 17 around each of the valve ports 31.

The preferred embodiment of the pump as hereinabove described provides overflow ports 57 for returning excessive liquid in space 58 to dewar 13 or for transferring helium from the dewar 13 to the space 58. These ports 57 also serve the purpose of substantially equalizing the pressure of the vapor zones above the liquid in space 58 and above the supply liquid 14 in dewar 13. It is an important feature of this invention that the pressure on the liquid in the space 58 above piston 15 is substantially below that of the compressed fluid in the pumping chamber 19 and the discharge chamber 40 during the downward stroke. As the pressure on the liquid in the space 58 approaches the pump discharge pressure, an excessive amount of liquid can flow through the clearance into pumping chamber 19, during the upward stroke. Furthermore, during the downward stroke, such a high pressure on the liquid above the piston 15 can impede the flow of fluid past piston 15 into space 58. In addition, if the liquid in the space 58 were at a pressure at about or above pump discharge pressue during the upward stroke, then liquid drawn into pumping chamber 19 from space 58 would rapidly vaporize on expansion.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A pump for compressing and transferring a cryogenic liquid which is in a container, the pump when mounted vertically comprising a closed tubular member mounted vertically inside said container, a piston mounted for vertical reciprocal movement in said tubular member, motive means for reciprocating said piston, inlet means for the passage of liquid from said container to a variable volume pumping chamber in said tubular member below said piston during the upward stroke of the piston, outlet means for the passage of liquid from said pumping chamber during the downward stroke of said piston, means spacing said piston from the inside wall of the tubular member by a predetermined clearance, said clearance being large enough for vapor in said pumping chamber to be forced through the clearance into the space above the piston enclosed by the tubular member during the downward stroke of the piston, liquid supply and control means for maintaining a supply of said liquid in the space above the piston large enough to prevent vapor from flowing through said clearance into said pumping chamber from above the piston, and pressure control means for maintaining said liquid supply in the space above said piston at a pressure substantially less than the pressure of the liquid in said pumping chamber during the downward stroke of said piston.

2. The pump of claim 1 further comprising means for passing liquid from the pump outlet in heat exchange relation with the fluid in the container.

3. The pump of claim 1 further comprising means for thermally insulating the liquid from the pump outlet from the fluid in the container.

4. The pump of claim 1 wherein said inlet means comprises a valve in the bottom end of the tubular member.

5. The pump of claim 1 in which the pressure control means comprises means for removing vapor from said space above the piston.

6. The pump of claim 5 wherein said predetermined clearance is large enough so that liquid and vapor pass therethrough during the downward stroke of said piston.

7. The pump of claim 6 wherein said means for removing vapor comprises said tubular member having holes formed therethrough to provide communication between the space above the piston and the inside of the container.

8. The pump of claim 1 in which the outlet means comprises a plurality of outlet valves circumferentially spaced about and near the bottom of said tubular member, a wall member surrounding the pumping chamber exterior to the lower portion of the tubular member and forming a discharge chamber between said wall member and the lower portion of said tubular member, and said outlet valves communicating between the pumping chamber and the discharge chamber.

9. The pump of claim 8 further comprising means including said wall member for thermally insulating the fluid in the discharge chamber from the fluid in the container.

10. The pump of claim 1 further comprising a plurality of spaced ringlike members mounted on the periphery of said piston, said piston with said ringlike members thereon forming with the juxtaposed wall of said tubular member a succession of restriction zones and expansion zones, whereby as fluid is forced through said clearance past said ringlike members it is successively compressed and expanded.

11. The pump of claim 10 in which the pressure control means comprises means for removing vapor from said space above the piston.

12. The pump of claim 11 wherein said predetermined clearance is large enough so that liquid and vapor pass therethrough during the downward stroke of said piston.

13. The pump of claim 12 wherein said means for removing vapor comprises said tubular member having holes formed therethrough to provide communication between the space above the piston and the inside of the container.

14. The pump of claim 13 in which the outlet means comprises a plurality of outlet valves circumferentially spaced about and near the bottom of said tubular member, a wall member surrounding the pumping chamber exterior to the lower portion of the tubular member and forming a discharge chamber between said wall member and the lower portion of said tubular member, and said outlet valves communicating between the pumping chamber and the discharge chamber.

15. The pump of claim 14 wherein said inlet means comprises a valve in the bottom end of the tubular member.

* * * * *

UNITED STATES PATENT OFFICE

CERTIFICATE OF CORRECTION

PATENT NO. 4,156,584

DATED May 29, 1979

INVENTOR(S) Thomas W. Schuck

It is certified that error appears in the above-identified patent and that said Letters Patent are hereby corrected as shown below:

Col. 3, line 8 for "cyliner" read -- cylinder --

Col. 5, line 4 for "od" read -- rod --

Col. 5, line 43 for "in" read -- is --

Col. 6, line 36 after "inlet" insert -- valve --

Col. 6, line 42 for "therising" read -- the rising --

Col. 9, line 13 for "diameter" read -- surface --

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*